United States Patent [19]

Thibodeau et al.

[11] 4,096,302

[45] Jun. 20, 1978

[54] BACKING FOR TUFTED CARPET OF A THERMOPLASTIC NET AND PLURALITY OF FIBERS

[75] Inventors: Raymond Jon Thibodeau, Wayzata; Edward V. Burchell, New Brighton, both of Minn.

[73] Assignee: Conwed Corporation, St. Paul, Minn.

[21] Appl. No.: 719,853

[22] Filed: Sep. 2, 1976

[51] Int. Cl.[2] ..... D03D 27/00; D04H 11/00

[52] U.S. Cl. ..... 428/95; 428/137; 428/219; 428/255; 428/227; 428/238; 428/474; 428/516; 428/921

[58] Field of Search ..... 428/95, 137, 219, 255, 428/227, 238, 921, 516, 474; 264/DIG. 81

[56] References Cited

U.S. PATENT DOCUMENTS

| | | | |
|---|---|---|---|
| 3,347,736 | 10/1967 | Sissons | 428/95 X |
| 3,708,384 | 1/1973 | Carpenter | 428/95 X |
| 3,775,232 | 11/1973 | Gomory | 428/95 |
| 3,861,992 | 1/1975 | DeNobriga et al. | 428/95 |
| 3,955,022 | 5/1976 | Sands | 428/95 |

*Primary Examiner*—P. C. Ives

*Attorney, Agent, or Firm*—Eyre, Mann, Lucas & Just

[57] ABSTRACT

A carpet backing for tufted carpets comprising non-woven fiber material secured to plastic netting is disclosed. The non-woven fiber material is secured to the netting by needle punching. The carpet yarn may thereafter be tufted into the backing.

10 Claims, 2 Drawing Figures

BACKING FOR TUFTED CARPET OF A THERMOPLASTIC NET AND PLURALITY OF FIBERS

Figure 1:
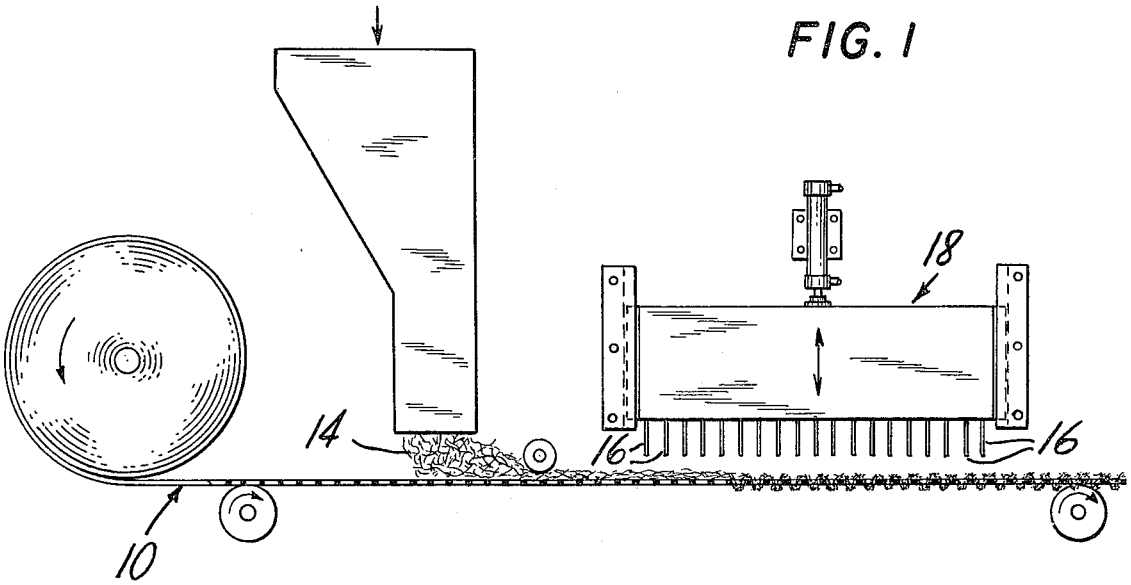

The present invention relates to backings for tufted carpets.

Tufted carpets are well known in the art and are usually produced from continuous strands of nylon, polyester, acrylic or like materials poked through a backing material. The backing materials commonly employed are woven fabrics and perhaps the most common fabric in use today is one formed from polypropylene wherein the polypropylene is first made as a film, slit into strips, and then woven to form the fabric. While these backing materials are generally satisfactory, they are quite expensive and have a serious process disadvantage associated with the application of the backing adhesive in that it is difficult to get the adhesive to penetrate through the fabric to the base of the tufted material. This is especially a problem where the backing material is a plastic woven fabric or a plastic film. Additionally, it is usually necessary to "hide" the backing material which is visible through the tufted material. This is sometimes done with fibers but the purpose of the fibers is only to hide the backing material and not to aid in holding the tufts in place.

In accordance with the present invention, the foregoing disadvantages are obviated, costs substantially reduced and additional advantages realized.

The present invention is embodied in and carried out by tufted carpets having a backing comprising nonwoven fiber material secured to plastic netting. In accordance with the present invention, fiber material is deposited on the plastic net with the fibers aligned in a single direction, the woof direction. Thereafter, the fibers are secured to the net by needle punching the fibers through the net. The fibers may be deposited and punched through the net serially one side at a time or by depositing the fibers on both sides of the net and simultaneously needle punching the fibers through both sides of the net in known manner with a double acting loom.

After the backing has been formed in accordance with the invention, carpet yarn is tufted into the backing. The tufts are held in the backing primarily by the fibers but backing adhesive may also be applied to the tufted carpet if desired. In accordance with the invention, the fiber material may comprise nylon, rayon and the like, preferably dyeable, and with a fiber length of from about 1 to about 6 inches, preferably from about 2 to about 4 inches. Further in accordance with the invention, the quantity of fiber deposited and secured to the net is from about 3 oz/yd$^2$, to about 10 oz/yd$^2$, and preferably from about 6 oz/yd$^2$ to about 8 oz/yd$^2$.

The plastic net to which the fibers are attached is suitably a thermoplastic or thermoset plastic material, preferably a thermoplastic material such as a polyolefin, suitably polypropylene. The plastic net in accordance with the invention has a strand count of from about 12 $\times$ 12 per square inch to about 4 $\times$ 4 per square inch, preferably 10 $\times$ 10 to 6 $\times$ 6 and a weight of from about 2 pounds per thousand square feet (lbs/MSF) to about 10 lbs/MSF, preferably from about 3 to about 8. The nets of the present invention are preferably nets with strands which are integrally extruded at the joints. Flat net-like structures are preferred because there are no raised joints which may interfere with the securing of the fiber material thereto. Processes suitable for making these nets are taught for example according to U.S. Pat. Nos. 3,252,181 and 3,384,692 wherein a plurality of parallel longitudinal strands are extruded and a plurality of parallel transverse strands are integrally extruded therewith normal to the longitudinal strands at spaced intervals. Alternatively but less desirably processes such as those disclosed in U.S. Pat. Nos. 3,767,353 and 2,919,467 may be employed.

it is preferred that the net be oriented after it is extruded. By orienting it is meant that the reinforcing net is heated and stretched at a temperature above its second glass transition temperature whereby the net takes a permanent stretch to a dimension at least three times as great as its unoriented dimension. Orienting the net increases its tensile strength, reduces weight and also reduces cost. Apparatuses and methods for orienting net-like materials are well known in the art and are shown for example in British Pat. Nos. 1,235,901 and 905,252.

In accordance with the preferred embodiment of the invention, nylon fiber is deposited on polypropylene oriented net, aligned in a single direction, the woof direction, as opposed to the warp direction, whereafter a tacking loom punches the fiber material through the net. The fiber material is punched through the net over the range of about 300 punches per square inch to about 1500 punches per square inch, about 1000 punches per square inch being typical. It is preferred that the fiber material be deposited on and punched through a single side of the net and then turned over and punched through the other side. However, it is suitable to punch both sides of the net simultaneously using a double acting loom.

In one embodiment, the present invention teaches a tufted carpet comprising a carpet backing, said carpet backing comprising a plurality of fibers and a thermoplastic net, said fibers being essentially aligned in the woof direction and being secured to said net by being punched therethrough, said fibers having a fiber length of from about 1 inch to about 6 inches, said fibers being present on each side of said net at a rate of from about 3oz/yd$^2$ to about 10 oz/yd$^2$, said net comprising at least two sets of strands, said strands being extruded having integral intersections and said net having a strand count of from about 4 $\times$ 4 to about 12 $\times$ 12 per square inch and a weight of from about 2 pounds per 1000 square feet to about 10 pounds per 1000 square feet, carpet yarn tufted into said carpet backing, and backing adhesive effective to further secure said tufted carpet yarn to said backing.

The practice of the present invention is more clearly illustrated in the Figures and in the Example.

Figure 2:
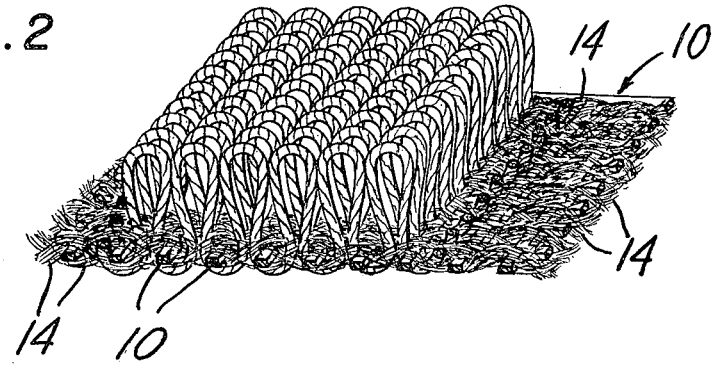

FIG. 1 shows punching of the backing material fibers through one side of the reinforcing net; and FIG. 2 shows the finished tufted carpet.

In FIG. 1 there is shown a net 10 moving in the direction of the arrow. Nylon fibers 14 are deposited on the moving net 10 and are punched through the interstices in the net by the pins 16 of loom 18 which reciprocates as shown. After the fibers are punched through from one side, the net is reversed and additional fibers are punched through from the other side in the same manner as that shown in FIG. 1.

FIG. 2 shows a portion of the finished carpet backing with the carpet tufted therethrough.

EXAMPLE

Nylon fibers of 15 denier having an average length of about 2½ to 3 inches are deposited on one side of an oriented polypropylene net having a strand count of 8 × 8 per square inch and a weight of 2½ lbs/MSF. The fibers are deposited aligned in the woof direction on the net at about 8 oz/yd$^2$ . The fibers are then needle punched through the net at about 1000 punches per square inch. The foregoing is repeated for the other side of the net to form the carpet backing according to the invention. Thereafter, nylon yarn is tufted into the carpet backing in known manner with a needle spacing of about 3/16 inch. A suitable backing adhesive, typically a latex, is applied to the base of the carpet backing and is permitted to penetrate through to the base of the tufted carpet yarn. The backing adhesive advantageously includes a suitable dye and a fire retardant.

In accordance with the present invention, the cost of tufted carpet made according to the invention is substantially reduced over the known tufted carpets having woven fabric backing material. Additionally, the carpet backing according to the invention exhibits resiliency which is not only advantageous per se but which also makes possible a reduction in the quantity of tufting material, thereby further reducing costs. This result is achieved because the backing itself actually imparts resiliency to the carpet due to its unique construction. Further advantage is realized with respect to the application of the backing adhesive and the relative ease of application thereof and penetration through the carpet backing. In accordance with the present invention, it is not necessary to make separate provision for "hiding" the carpet backing, a costly step in known methods, as inclusion of a dye in the backing adhesive penetrates and wicks throughout the fiber backing material. The presence of the net in the carpet backing insures that the backing has superior longitudinal and transverse strength. The tufted carpet of the present invention exhibits reduced weight and greater strength as well as good carpet feel and appearance. This is due to the fiber-net combination which is resilient, lightweight and strong and in which the dyed fiber is capable of obscuring the net.

The advantages of the present invention, as well as certain changes and modifications of the disclosed embodiment thereof, will be readily apparent to those skilled in the art. It is the applicants' intention to cover by their claims all those changes and modifications which could be made to the embodiment of the invention herein chosen for the purpose of illustration without departing from the spirit and scope of the invention.

What is claimed is:

1. Carpet backing for tufted carpets comprising a plurality of fibers and a thermoplastic net, said fibers being essentially aligned in the woof direction and being secured to said net by being punched therethrough said fiber having a fiber length of from about 1 inch to about 6 inches, said fiber being present on each side of said net at a rate of from about 3 oz/yd$^2$ to about 10 oz/yd$^2$, said net comprising at least two sets of strands, said strands being extruded and having integral intersections and said net having a strand count of from about 4 × 4 to about 12 × 12 per square inch and a weight of from about 2 pounds per thousand square feet to about 10 pounds per thousand square feet.

2. The carpet backing of claim 1 wherein said fiber is selected from the group consisting of nylon and rayon.

3. The carpet backing of claim 1 wherein said fiber material is needle punched through said net over the range of about 300 to about 1500 punches per square inch.

4. The carpet backing of claim 1 wherein the said fibers are dyeable.

5. Tufted carpet comprising:

(a) a carpet backing said carpet backing comprising a plurality of fibers and a thermoplastic net, said fibers being essentially aligned in the woof direction and being secured to said net by being punched therethrough said fiber having a fiber length of from about 1 inch to about 6 inches, said fiber being present of each side of said net at a rate of from about 3 oz/yd$^2$ to about 10 oz/yd$^2$, said net comprising at least two sets of strands, said strands being extruded and having integral intersections and said net having a strand count of from about 4 × 4 to about 12 × 12 per square inch and a weight of from about 2 pounds per thousand square feet to about 10 pounds per thousand square feet;

(b) carpet yarn tufted into said carpet backing; and (c) backing adhesive effective to further secure said tufted carpet yarn to said backing.

6. The carpet backing of claim 5 wherein said fiber is selected from the group consisting of nylon and rayon.

7. The carpet backing of claim 5 wherein said fiber material is needle punched through said net over the range of about 300 to about 1500 punches per square inch.

8. The carpet backing of claim 5 wherein the said fibers are dyeable.

9. The tufted carpet of claim 5 wherein said adhesive includes a dye.

10. The tufted carpet of claim 5 wherein said adhesive includes a fire retardant.

* * * * *